US009951622B2

(12) United States Patent
Potelle et al.

(10) Patent No.: US 9,951,622 B2
(45) Date of Patent: Apr. 24, 2018

(54) SYSTEM FOR PAINTING A SPLAYED END OF A HOLLOW SHAFT ON A ROTARY PAINT BENCH

(71) Applicant: SNECMA, Paris (FR)

(72) Inventors: Damien Potelle, Saintry sur Seine (FR); Jacques Boulogne, Thiais (FR); Mathieu Meugnier, Etrechy (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 14/945,899

(22) Filed: Nov. 19, 2015

(65) Prior Publication Data

US 2016/0146011 A1 May 26, 2016

(30) Foreign Application Priority Data

Nov. 25, 2014 (FR) ..... 14 61428

(51) Int. Cl.

| | |
|---|---|
| ***F01D 5/02*** | (2006.01) |
| ***B05B 13/02*** | (2006.01) |
| ***B05B 13/06*** | (2006.01) |
| ***B05B 13/04*** | (2006.01) |
| ***B05B 15/04*** | (2006.01) |

(52) U.S. Cl.

CPC ..... *F01D 5/02* (2013.01); *B05B 13/0207* (2013.01); *B05B 13/0214* (2013.01); *B05B 13/0228* (2013.01); *B05B 13/0442* (2013.01); *B05B 13/0618* (2013.01); *B05B 13/0645* (2013.01); *B05B 15/045* (2013.01); *F05D 2230/90* (2013.01); *F05D 2240/61* (2013.01)

(58) Field of Classification Search

CPC ..... B25B 1/00

USPC ..... 118/321, 325, 500, 503, 317, 306; 269/43, 45; 29/278, 281.1; 427/231

See application file for complete search history.

(56) References Cited

U.S. PATENT DOCUMENTS 2,388,159 A * 10/1945 Kmentt ..... B05C 1/08 118/233
2,774,134 A * 12/1956 Smith ..... F16L 1/10 269/296
7,470,328 B1 * 12/2008 Archer, Jr. ..... B05C 11/08 118/500

FOREIGN PATENT DOCUMENTS

| | | |
|---|---|---|
| EP | 0 221 845 A1 | 5/1987 |
| JP | 2010-5575 | 1/2010 |
| WO | WO 2013/178941 A1 | 12/2013 |

OTHER PUBLICATIONS

English Translation JP2010005575A, Jun. 30, 2008.*

(Continued)

*Primary Examiner* — Yewebdar T Tadesse

(74) *Attorney, Agent, or Firm* — Oblon, McClelland, Maier & Neustadt, L.L.P.

(57) ABSTRACT

A system paints the external and internal faces of a splayed end of a hollow shaft, with a rotary paint bench. This splayed end includes an end support face and an opposite support face. The system includes a fixing ring applied against the end support face and a counter-ring applied against the opposite support face as well as a fixing device, an end hub fixed to the fixing ring in line with the splayed end, and including a running belt suitable for resting on two rollers of the bench, a hollow external hub including two half-hubs delimiting a running belt suitable for resting on two rollers of the bench, and fixed to the counter-ring while surrounding the splayed end.

10 Claims, 3 Drawing Sheets

(56) References Cited

OTHER PUBLICATIONS

French Preliminary Search Report dated Jul. 17, 2015 in French Application 14 61428, filed on Nov. 25, 2014 (with English Translation of Category of Cited Documents).

* cited by examiner

SYSTEM FOR PAINTING A SPLAYED END OF A HOLLOW SHAFT ON A ROTARY PAINT BENCH

The invention relates to the external and internal surfaces of a splayed shaft end on a paint bench.

TECHNICAL FIELD

Painting a part of revolution on a rotary paint bench is done by equipping the ends of this part with hubs provided with running belts and installing the assembly on the bench so that each running belt is in abutment on a pair of rotary rollers on this bench.

The outside of the part is thus painted for example with a paint gun carried by a robotic arm that is moved along it, at the same time as it is rotating on itself while being driven by the rotary rollers of the bench.

With this type of process, painting the inside and outside of one end of a hollow shaft is complicated by the fact that the hub attached to this end at least partially closes the inside of this end.

PRIOR ART

The subject matter of the invention is a system of components for successively painting the inside and outside of a splayed end of a hollow shaft.

SUMMARY OF THE INVENTION

To this end, the subject matter of the invention is a system for painting an external face and an internal face of a splayed end of a hollow shaft extending along a longitudinal axis, with a rotary paint bench comprising means for rotating and supporting the shaft and a paint gun, this splayed end comprising a flange delimited by an end support face and an opposite support face of orientation normal to the longitudinal direction and intended to remain devoid of paint, this system comprising:

- a fixing ring applied against the end support face and a counter-ring applied against the opposite support face, or vice versa, as well as means for fixing by clamping by means of which the ring and the counter-ring grip the flange of the splayed end;
- a hollow external hub of revolution delimiting a running belt suited to the means for rotating the bench in order to support the splayed end of the shaft, this hollow hub being fixed to the counter-ring or fixing ring that is applied against the opposite support face of the flange while externally surrounding the splayed end of the shaft while leaving clear the internal face of this splayed end.

The system of components according to the invention thus makes it possible to paint the two faces of the splayed end on a rotary bench without having to wait for the first of the faces to be completely dried in order to proceed with the painting of the other face, and this without any risk of damaging the paint on the first face.

The invention also relates to a system thus defined, further comprising an end hub fixed removably to the fixing ring or counter-ring that is applied against the end support face while extending in line with the splayed end, this end hub comprising a running belt suited to the means for rotating the paint bench of the shaft while partially closing off this end.

The invention also relates to a system thus defined, in which the hollow external hub comprises two parts in the form of complementary semicylindrical half-hubs conjointly forming an assembly of revolution.

The invention also relates to a system thus defined, in which the means for driving the paint bench comprise rollers able to receive the running belt of the end hub and the running belt of the hollow external hub.

The invention also relates to a system thus defined in which the fixing ring is applied against the end support face and in which the counter-ring is applied against the opposite support face.

The invention also relates to a system thus defined, in which the fixing ring is provided with several through studs for fixing the counter-ring and fixing the end hub.

The invention also relates to a system thus defined, in which the counter-ring comprises threads for fixing the hollow external half-hubs.

The invention also relates to a method for painting an external face and an internal face of a splayed end of a hollow shaft extending in a longitudinal direction, with a system according to one of the preceding claims, comprising, at its flange, an end support face and an opposite support face, this method comprising the steps of:

- applying the fixing ring against the end support face and the counter-ring against the opposite support face and fixing them with the fixing means;
- mounting the end hub by fixing it to the fixing ring and installing the shaft on a rotary paint bench so that its splayed end is supported by means of the end hub in abutment on two rollers of the rotary bench;
- rotating the shaft by means of the rotary bench and painting the external face of the splayed end;
- mounting the two semicylindrical half-hubs of the hollow external hub by fixing them to the counter-ring so that this hollow external hub surrounds the splayed end of the shaft;
- repositioning the shaft on the rotary bench so that its splayed end is supported by means of the hollow external hub in abutment on two rollers of the rotary bench, and removing the end hub in order to make the internal face of the splayed end accessible;
- rotating the shaft by means of the rotary bench and painting the internal face of the splayed end.

The invention also relates to a hollow turbine shaft having a splayed end with an external face and an internal face painted in accordance with the method thus defined.

The invention also relates to a turbomachine comprising a hollow shaft thus defined.

DETAILED DISCLOSURE OF PARTICULAR EMBODIMENTS

The idea at the basis of the invention is a ring and counter-ring both fixed to the splayed end and which serve throughout the painting and curing process for successively fixing a plurality of components conjointly holding the end in abutment on the bench and leaving clear an end zone to be painted.

Figure 1:
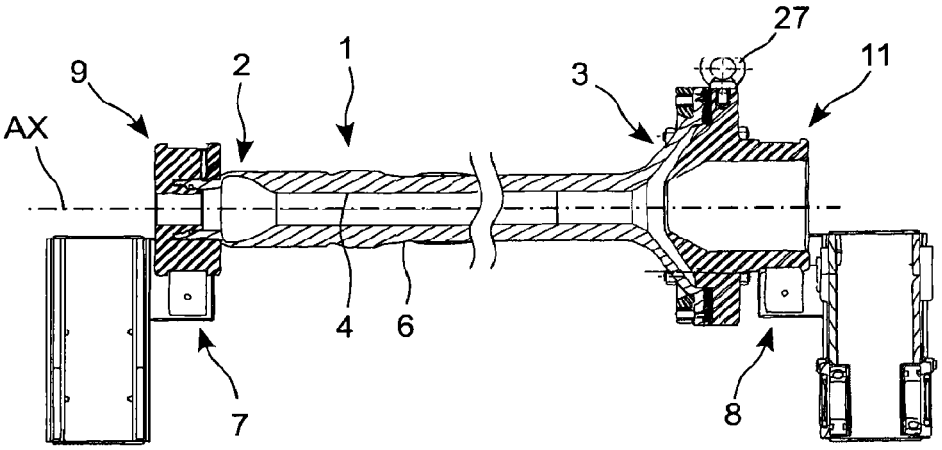
FIG. 1 is an overall view of a turbine shaft comprising a splayed end equipped with an end hub according to the invention by means of which this splayed end rests on two rollers of a rotary paint bench.

In FIG. 1, the turbine shaft of a turbomachine such as a turbojet 1 according to the invention extends longitudinally in a direction AX from a fluted end 2 as far as a splayed end 3 in the form of a roughly conical mouth. This shaft, which is hollow, comprises an internal surface 4 and an external surface 6, which must both be painted, with paint applied by gun, and which then have to be cured in an oven.

As can be seen in FIG. 1, this shaft 1 is here installed on a rotary paint bench comprising a first support with rollers 7 and a second support with rollers 8, the shaft being in abutment on these roller supports at its ends 2 and 3.

The fluted end 2 of the shaft 1 is equipped with an end hub 9 that is fitted on this end and fixed thereto by clamping with a screw engaged in a threaded hole passing radially through this end hub. This end hub comprises, at its external face, a running track by means of which it is in abutment on two support rollers 7 so as to be able to rest on this support while enabling the shaft to rotate about its longitudinal axis.

The splayed end 3 is equipped with an end hub 11 partially closing off this end 3 while extending it. This end hub 11 also has a form of revolution, the external face of which delimits a running track designed to rest on two complementary rollers of the second support 8.

One or other or both of the supports 7 and 8 are motorised in order to drive their rollers, which makes it possible to rotate the shaft 1 resting on these rollers.

In the configuration in FIG. 1, the shaft 1 is equipped with its end hub 9 and its end hub 11, by means of which it rests on the supports 7 and 8 of the rotary paint bench. It is then possible to proceed with a first operation for painting firstly the whole of its external surface 6, secondly the external surface 4 apart from in the internal region of the mouth that is obstructed by the end hub 11.

The paint on the external face is applied for example with equipment of the gun type carried by a robotic arm, in accordance with movements coordinated with the rotation of the shaft provided by the driving of roller supports 7 and 8.

The paint is applied to the internal face 4 with equipment comprising a paint-dispensing nozzle that is moved longitudinally in the hollow shaft in rotation while being installed at the end of a removable rod.

Figure 2:
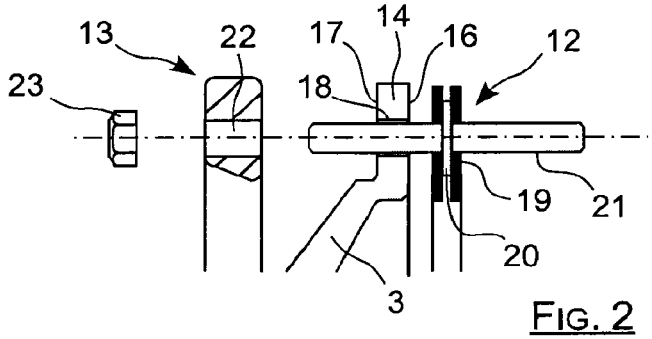
FIG. 2 is a detail view of the mounting on the splayed end of the fixing ring and counter-ring according to the invention.
Figure 3:
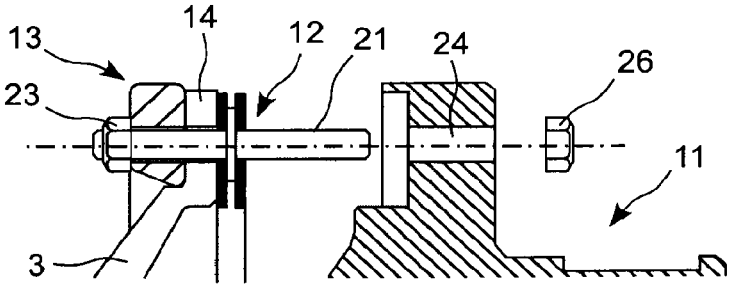
FIG. 3 is a detail view in cross-section of the mounting of the end hub on the fixing ring according to the invention.
Figure 4:
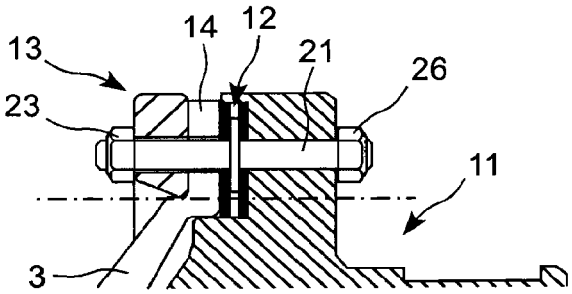
FIG. 4 is a detail view showing the end hub mounted on the fixing ring itself secured to the splayed end in accordance with the invention.

As depicted more clearly in FIGS. 2 to 4, the end hub 11 is fixed to the splayed end 3 by means of a fixing ring 12 and a counter-ring 13 that are themselves fixed to the periphery forming a flange 14 of this end 3.

More particularly, the periphery 14 of the end 3 has a flange form having an end support face 16 and an opposite support face 17. These are two flat faces in the form of a ring centred on the axis AX and with orientation normal to the axis AX, and between which the wall forming the flange 14 extends.

This flange 14 comprises here four through piercings, one of which is shown in FIG. 2 being marked 18, oriented parallel to the axis AX, regularly spaced apart about the axis AX, and intended for mounting mechanical components of the turbine.

As can be seen in FIGS. 2 to 4, these piercings are used in the painting process in order to fix the fixing ring 12 and the counter-ring 13 to the flange 14 of the mouth 3, by means of studs.

The fixing ring 12 comprises a body 19 with a roughly toric shape with a rectangular cross-section on which four through double studs are mounted, one of which is marked 21 in FIGS. 2 to 4. Each stud extends parallel to the axis of revolution of the body 19 and projects beyond the two sides of this body 19 while being rigidly secured thereto. As can be seen in FIG. 2, each double stud may comprise a collar 20 situated halfway along its length and this collar may be embedded or integrated in the thickness of the body 19.

The mounting of the ring 12 and counter-ring 13 consists firstly of offering up the ring 12 facing the flange 14 of the end 3 while placing the studs 21 facing the holes 18 in this flange and pressing the body 19 against the end support face 16 while engaging the studs 21 in the holes 18. The studs 21 project through the opposite face 17, which makes it possible to move the counter-ring 13 against this opposite face 17 while engaging the projecting portions of the studs 21 in corresponding piercings 22 in this counter-ring 13.

In this situation, the studs 21 project from the counter-ring 13 that they pass through, which makes it possible to screw in a nut 23 on each of these studs, and to tighten these nuts 23 in order to securely fix the ring 12 and counter-ring 13, which thus grip the flange 14 of the end 3 of the shaft 1.

This situation, which corresponds to FIG. 3, makes it possible to mount the end hub 11 on the fixing ring 12, by means of the second halves of the studs 21, which all project from the body 19 of the fixing ring 12. The end hub 11 comprises for this purpose four through holes 24, so that its mounting consists of moving the ring body 19 close in order to put it in abutment against it while engaging the studs 21 in the holes 24.

Once the end hub 11 is in place, nuts 26 can be screwed onto each free end of a stud, and tightened so as to grip the periphery of the end hub 11 against the body of the ring 19, which corresponds to the situation in FIG. 4.

The mounting of the end hub 9, of the ring 12, of the counter-ring 13 and of the end hub 11 is achieved while having installed the shaft 1 so that it rests through its middle part on a suitable support.

As can be seen in FIG. 1, the end hub 11 comprises an attachment means 27 for facilitating the handling of the whole. The shaft 1 equipped with its end hub?? 9 and its end hub 11 can thus be handled by means suspended from lifting equipment comprising a member for attachment to the ring 27 and hook engaging at the fluted end 2.

The installation of the assembly on the paint bench thus consists of maneuvering the lifting equipment and positioning the hubs 9 and 11 in line with the support members 7 and 8 before lowering the assembly.

Once the painting of the whole of the external face 6 and of the internal face 4 apart from the region of the splayed end has been carried out, the assembly is reconfigured with a view to applying the paint to the internal face 4, in the region of the splayed end 3.

This new operation consists firstly of mounting an external hollow hub, marked 28, so that it surrounds the splayed end externally while being fixed to the counter-ring 13, this operation being performed while the assembly is in place on the rotary paint bench, in abutment with the supports 7 and 8.

Figure 5:
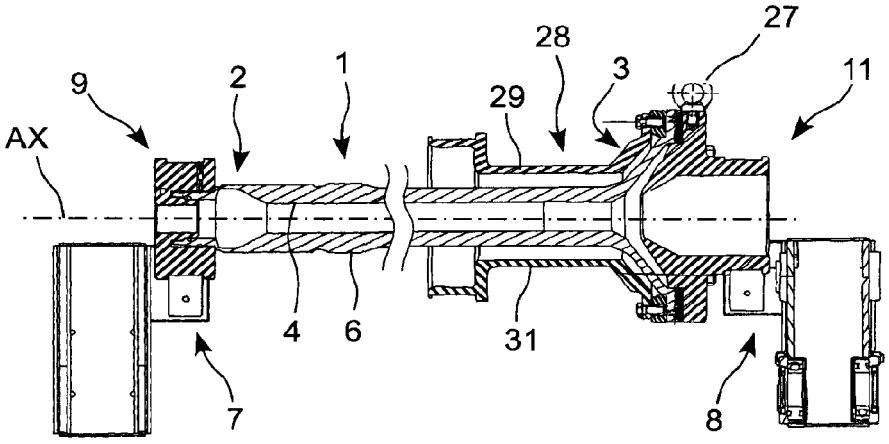
FIG. 5 is an overall view of the turbine shaft, the splayed end of which is equipped with an external hollow hub with two half-hubs according to the invention and the end hub by means of which this end rests on the two rollers of the rotary paint bench.

The hollow hub 28 is formed by two complementary and symmetrical roughly semicylindrical half-hubs that conjointly delimit an external running track when they are in place. These two half-hubs are referenced 29 and 31 in FIG. 5, where the first half-hub 29 is situated above the axis AX and the second half-hub 31 is situated below this axis.

Figure 6:
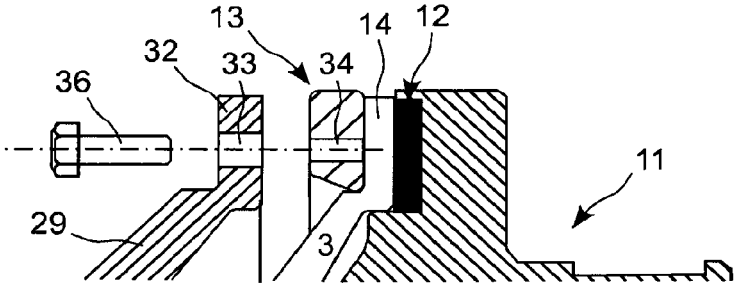
FIG. 6 is a detail view of the mounting on the counter-ring of a hollow half-hub according to the invention.

As can be seen in more detail in FIG. 6, the half-hub 29 comprises a rim 32 extending over a half-turn and is provided with three through holes oriented parallel to the axis AX. One of these piercings, referenced 33 in FIG. 6, is situated at the central region of the rim 32, and the other two piercings are situated in the vicinity of each end of this rim 32, which extends over substantially a half turn.

The mounting of the half-hub 29 thus consists of placing it along the shaft 1 at the end 3 and applying its rim 32 in abutment against the free face of the counter-ring 13 while positioning it around the axis AX so as to place its three piercings 33 opposite corresponding threaded holes 34 in the counter-ring 13. Naturally the threads 34 of the counter-ring are distant from the piercings 22 of this same counter-ring.

Figure 7:
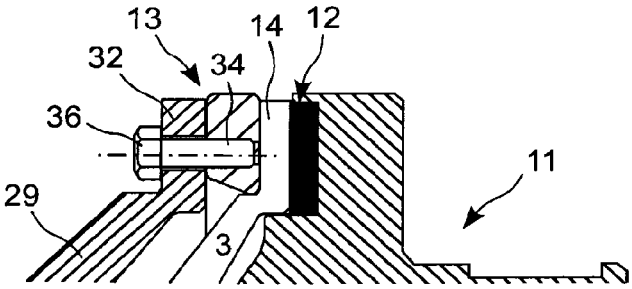
FIG. 7 is a detail view showing the hollow half-hub mounted on the counter-ring itself fixed to the splayed end in accordance with the invention.

When this positioning is carried out, three screws 36 can be engaged in the piercings 33 and screwed into the threaded piercings 34, and then tightened in order to clamp the half-hub 29 against the counter-ring 13, which corresponds to the situation in FIG. 7.

The half-hub 31 is mounted in a similar fashion, by positioning it opposite the half-hub 29 about the axis AX.

Once the two half-hubs 29 and 31 are thus in place and mounted, they conjointly delimit an external hub 28 comprising a running track for the support rollers 8.

Figure 8:
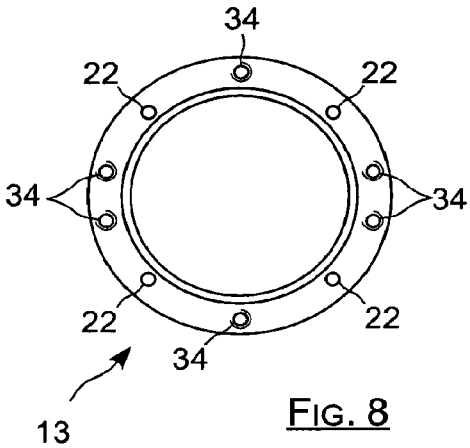
FIG. 8 is a front view of the counter-ring showing the threads and piercings of this counter-ring according to the invention.
Figure 9:
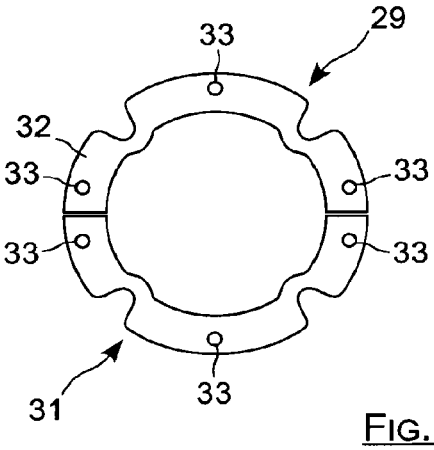
FIG. 9 is a front view of the two half-hubs forming the hollow hubs in accordance with the invention.

As can be seen in FIG. 8, the counter-ring 13 thus comprises four piercings 22 at ninety degrees from one another, which are intended to receive the four studs 21, and six threads 34 intended to receive the fixing screws 36 of the half-hubs 29 and 31.

When the external hub 28 is in place, the end 3 can be raised by handling equipment by means of the ring 27, before moving the support 8 in order to position it vertically in line with the running track of the hollow hub 28. The equipment is then controlled in order to lower the shaft, so as to place the running track of the hollow hub 28 on the support rollers 8, as is the case in FIG. 10.

When the assembly is in place with the splayed end supported by the running track of the hollow hub 28, the end hub 11 that obstructs the internal face of the splayed end 3 can be removed in order to make it possible to paint the internal face of this end.

Figure 10:
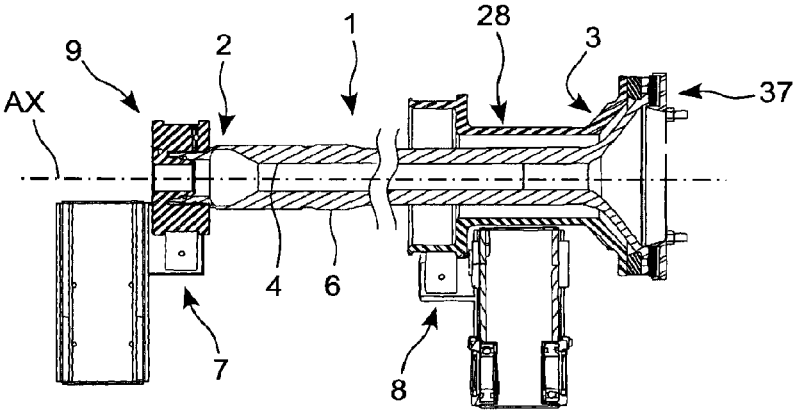
FIG. 10 is an overall view of the turbine shaft, the splayed end of which is equipped with the hollow hub by means of which this end rests on two rollers of the paint bench and a circumferential mask.
Figure 11:
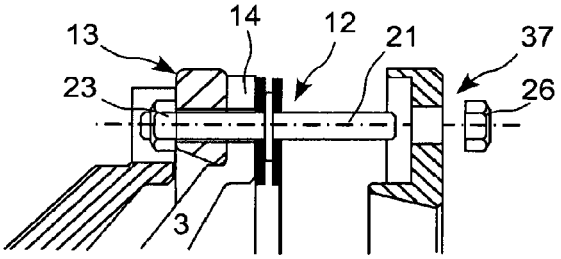
FIG. 11 is a detail view of the mounting of the circumferential mask on the fixing ring according to the invention.
Figure 12:
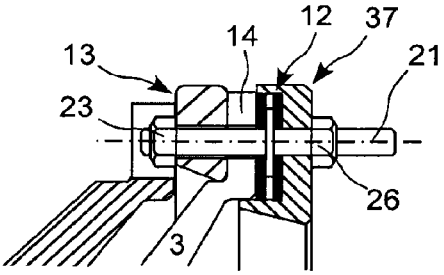
FIG. 12 is a detail view showing the circumferential mask fixed to the ring according to the invention.

This removal is done by unscrewing the corresponding nuts on the studs, namely the nuts 26, in order to remove the end hub 11, before fitting a circular mask 37 that is fixed to the ring 12 in the same way as the end hub 31, as illustrated by FIGS. 10 and 11, namely by engaging on the projecting parts of the studs 21 and being clamped by means of the nuts 26.

By virtue of its circular ring shape, the mask 37 leaves access free to the inside of the end 3, which is moreover also not obstructed by the presence of the support 8 since the latter is offset by being at the rear with respect to the end 3, that is to say opposite the main portion of the shaft, in order to be in abutment on the running track of the hollow hub 28.

The inside of the splayed end can thus be painted by rotating the shaft on the bench and moving a paint gun close to this end.

Figure 13:
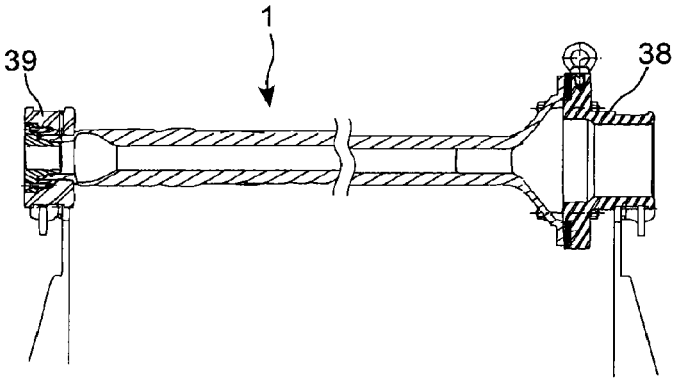
FIG. 13 is a general view of the turbine shaft equipped with a roller and an end hub in place on a support with a view to the curing of the paint.

When the painting is finished, the mask 37 can in its turn be replaced by another end hub 38 visible in FIG. 13, and the end hub 9 can be replaced with another end hub 39, with a view to proceeding with the curing of the paint in a stove or oven, the assembly having been transferred to another support.

In general terms, the use of a fixing ring and a counter-ring makes it possible easily to mount and remove the various elements that constitute the end hub, the hollow hub and other components without risk of damaging the paint that has just been applied to the hollow shaft.

In the example that has been described, the hollow hub is in two parts, giving it a roughly tubular shape, but it may also be provided with a short length and a greater diameter than the flange in order to make it possible also to paint the external face of the shaft in the vicinity of the flange without having to use an end hub. The invention then makes it possible to paint the two faces of the shaft without having to change hub.

The invention claimed is:

1. A system for painting an external face and an internal face of a splayed end of a hollow shaft extending along a longitudinal axis, with a rotary paint bench comprising means for rotating and supporting the hollow shaft and a paint gun, the splayed end comprising a flange delimited by an end support face and an opposite support face of orientation normal to the longitudinal direction and intended to remain devoid of paint, the system comprising:

a fixing ring applied against the end support face and a counter-ring applied against the opposite support face, or vice-versa, as well as means for fixing by clamping by which the fixing ring and the counter-ring grip the flange of the splayed end;

a hollow external hub of revolution delimiting a running belt suited to means for rotating the rotary paint bench in order to support the splayed end of the hollow shaft, the hollow external hub being fixed to the counter-ring or fixing ring that is applied against the opposite support face of the flange while externally surrounding the splayed end of the hollow shaft and leaving clearance at the internal face of the splayed end.

2. The system according to claim 1, further comprising an end hub fixed removably to the fixing ring or counter-ring that is applied against the end support face while extending in line with the splayed end, the end hub comprising a running belt suited to the means for rotating the rotary paint bench for painting the hollow shaft while partially closing off the splayed end.

3. The system according to claim 1, wherein the hollow external hub comprises two complementary parts in the form of semicylindrical half-hubs conjointly forming an assembly of revolution.

4. The system according to claim 2, wherein a means for driving the rotary paint bench comprise rollers able to receive the running belt of the end hub and the running belt of the hollow external hub.

5. The system according to claim 3, wherein the counter-ring comprises threads for fixing the hollow external half-hubs.

6. The system according to claim 1, wherein the fixing ring is applied against the end support face and in which the counter-ring is applied against the opposite support face.

7. The system according to claim 2, wherein the fixing ring is provided with several through studs for fixing the counter-ring and fixing the end hub.

8. A method for painting an external face and an internal face of a splayed end of a hollow shaft extending in a longitudinal direction, with a system according to claim 1, the splayed end comprising, at a flange, an end support face and an opposite support face, the method comprising:

applying the fixing ring against the end support face and the counter-ring against the opposite support face and fixing the fixing ring, the counter-ring, and the flange with the means for fixing;

mounting an end hub by fixing the end hub to the fixing ring and installing the hollow shaft on the rotary paint bench so that the splayed end is supported by the end hub in abutment on two rollers of the rotary paint bench;

rotating the hollow shaft by the rotary paint bench and painting the external face of the splayed end;

mounting two semicylindrical half-hubs of the hollow external hub by fixing the two semicylindrical half-hubs to the counter-ring so that the hollow external hub surrounds the splayed end of the hollow shaft;

repositioning the hollow shaft on the rotary paint bench so that the splayed end is supported by the hollow external hub in abutment on two rollers of the rotary paint bench, and removing the end hub in order to make the internal face of the splayed end accessible;

rotating the hollow shaft by the rotary paint bench and painting the internal face of the splayed end.

9. A hollow turbine shaft comprising a splayed end having an external face and an internal face painted in accordance with the method according to claim 8.

10. The turbomachine comprising a hollow shaft according to claim 9.

* * * * *